US009746232B2

(12) United States Patent
Forrest

(10) Patent No.: US 9,746,232 B2
(45) Date of Patent: Aug. 29, 2017

(54) HEAT EXCHANGER ASSEMBLY HAVING A HEATED CONDENSATE DRAINAGE SYSTEM

(71) Applicant: MAHLE International GmbH, Stuttgart (DE)

(72) Inventor: Wayne O. Forrest, Gasport, NY (US)

(73) Assignee: MAHLE International GmbH, Stuttgart (DE)

( * ) Notice: Subject to any disclaimer, the term of this patent is extended or adjusted under 35 U.S.C. 154(b) by 120 days.

(21) Appl. No.: 14/705,461

(22) Filed: May 6, 2015

(65) Prior Publication Data

US 2016/0327331 A1 Nov. 10, 2016

(51) Int. Cl.
*F25D 21/14* (2006.01)
*F25B 39/00* (2006.01)

(52) U.S. Cl.
CPC ..... *F25D 21/14* (2013.01); *F25B 39/00* (2013.01); *F25B 2400/01* (2013.01)

(58) Field of Classification Search
CPC ..... F25D 21/14; F25D 21/00; B60H 1/3232; F28F 17/005; F24F 13/222
See application file for complete search history.

(56) References Cited

U.S. PATENT DOCUMENTS 2,136,222 A * 11/1938 Starr ..... A47F 3/0417 165/133
4,041,727 A * 8/1977 Maudlin ..... F24F 13/22 165/181
2006/0053818 A1* 3/2006 Yoshida ..... B60H 1/3233 62/285
2009/0151384 A1* 6/2009 Lee ..... B60H 1/3233 62/285
2013/0306280 A1* 11/2013 Goodman ..... F28F 1/12 165/109.1

* cited by examiner

*Primary Examiner* — Elizabeth Martin
(74) *Attorney, Agent, or Firm* — Brinks Gilson & Lione

(57) ABSTRACT

The disclosure presents a heat exchanger assembly for a heat pump system, having a heated condensate drainage system. The heat exchanger assembly includes a manifold with a plurality of pins extending substantially in the direction of gravity. A condensate drainage tray is positioned beneath the manifold. The drainage tray includes a plurality of drainage holes corresponding with the number and position of the pins. The pins extend from the manifold and through the corresponding the drainage holes of the drainage tray. Each of the plurality of pins includes a diameter smaller than the diameter of the drainage hole to allow for condensate to drain through the drainage hole. At least one of the pins includes a distal end and is tapered toward the distal end. The drainage tray may be tilted with respect to the manifold.

15 Claims, 3 Drawing Sheets

HEAT EXCHANGER ASSEMBLY HAVING A HEATED CONDENSATE DRAINAGE SYSTEM

TECHNICAL FIELD OF INVENTION

The present invention relates to a heat exchanger assembly for a heat pump system; more particularly, to a heat exchanger assembly having a condensate drainage system; still more particularly, to a heated condensate drainage system.

BACKGROUND OF INVENTION

A typical residential/commercial heat exchanger assembly used in a heat pump system, or otherwise known as a heat exchanger coil, includes a first manifold, a second manifold, and a plurality of refrigerant tubes hydraulically connecting the manifolds for refrigerant flow there between. Corrugated fins interconnect adjacent refrigerant tubes to increase the available heat transfer area, as well as to increase the structural integrity of the heat exchanger assembly. The refrigerant tubes and interconnecting corrugated fins together define the core of the heat exchanger. The heat exchanger assembly may function alternatively in evaporator mode or condenser mode, depending on the needs of the heat pump system.

A typical heat pump system typically includes an indoor heat exchanger assembly, an outdoor heat exchanger assembly, and a closed loop refrigerant system having a compressor that circulates a two phase refrigerant through the indoor heat exchanger assembly and outdoor heat exchanger assembly. When the heat pump system is in cooling mode, the indoor heat exchanger assembly operates in evaporator mode extracting heat energy from the indoor space to be cooled and the outdoor heat exchanger operates in condenser mode dispersing the heat energy to the outside ambient air. When the heat pump system is in heating mode, the outdoor heat exchanger assembly operates as an evaporator scavenging heat energy from the outside ambient air and the indoor heat exchanger assembly operates in condenser mode dispersing the heat energy to the indoor space to be heated. When the outdoor heat exchanger assembly is operating in evaporator mode, condensate may form onto the exterior surfaces of the outdoor heat exchanger assembly. If the outdoor ambient temperature is below the freezing temperature for water, the condensate may freeze and damage the outdoor heat exchanger assembly.

There remains a need to have an elegant solution to extract and convey frozen condensate away from the outdoor heat exchanger assembly during the cold winter months to minimalize the ice damage to the outdoor heat exchanger assembly.

SUMMARY OF THE INVENTION

The invention provides for a heat exchanger assembly for a heat pump system, having a heated condensate drainage system. The heat exchanger assembly includes a lower manifold and an elongated member, such as a pin, extending from a surface of the manifold in the direction of a drainage tray positioned below the manifold. The drainage tray includes at least one drainage hole having a shape complementary to the cross-sectional shape of the elongated member. The elongated member includes a cross sectional area sufficiently less than the area of the drainage hole such that the elongated member is capable of extending through the drainage hole with sufficient clearance available for condensate drainage. The elongated member may be formed of a heat conductive material amendable to brazing, such as aluminum. The drainage tray may be tilted at an angle with respect to the manifold.

An advantage of the heat exchanger assembly disclosed herein is that it provides a simple elegant solution to extract and convey condensate away from the heat exchanger assembly. The conveyance of condensate away from the heat exchanger assembly minimalizes the obstruction of airflow through the core, thereby improving heat transfer efficiency. Another advantage is that during the defrost cycle, the elongated members, or pins, conduct heat energy from the manifold to melt any ice that may have built up during the evaporator mode to clear a path for condensate to drain from the drainage tray.

BRIEF DESCRIPTION OF DRAWINGS

This invention will be further described with reference to the accompanying drawings in which.

DETAILED DESCRIPTION OF INVENTION

A heat pump system typically includes an indoor heat exchanger assembly and an outdoor heat exchanger assembly connected in series within a refrigerant loop. The heat exchanger assemblies are also known as heat exchanger coils. A two-phase refrigerant, such as R-134a or R-1234yf, is circulated through the refrigerant loop by a compressor. When the heat pump system is operating in heating mode, the suction side of the compressor receives a low pressure vapor phase refrigerant from the outdoor heat exchanger assembly, which is functioning as an evaporator, after scavenging heat from the outside ambient air. The compressor than compresses the low pressure vapor phase refrigerant into a hot high pressure vapor phase refrigerant, which is then discharged to the indoor heat exchanger, which functions as a condenser. As the high pressure vapor phase refrigerant is condensed to a high pressure liquid phase refrigerant in the indoor heat exchanger assembly, heat energy is dispersed to the space to be heated.

Occasionally, frost and ice builds up on the exterior surface of the outside heat exchanger assembly since the outdoor temperature is relatively cool or below freezing when there is a need to operate the heat pump system in heating mode. To defrost, or de-ice, the outside heat exchanger assembly, the refrigerant flow in the refrigerant loop is reversed, in which hot high pressure liquid refrigerant discharged from the compressor is routed to the outdoor heat exchanger.

Figure 1:
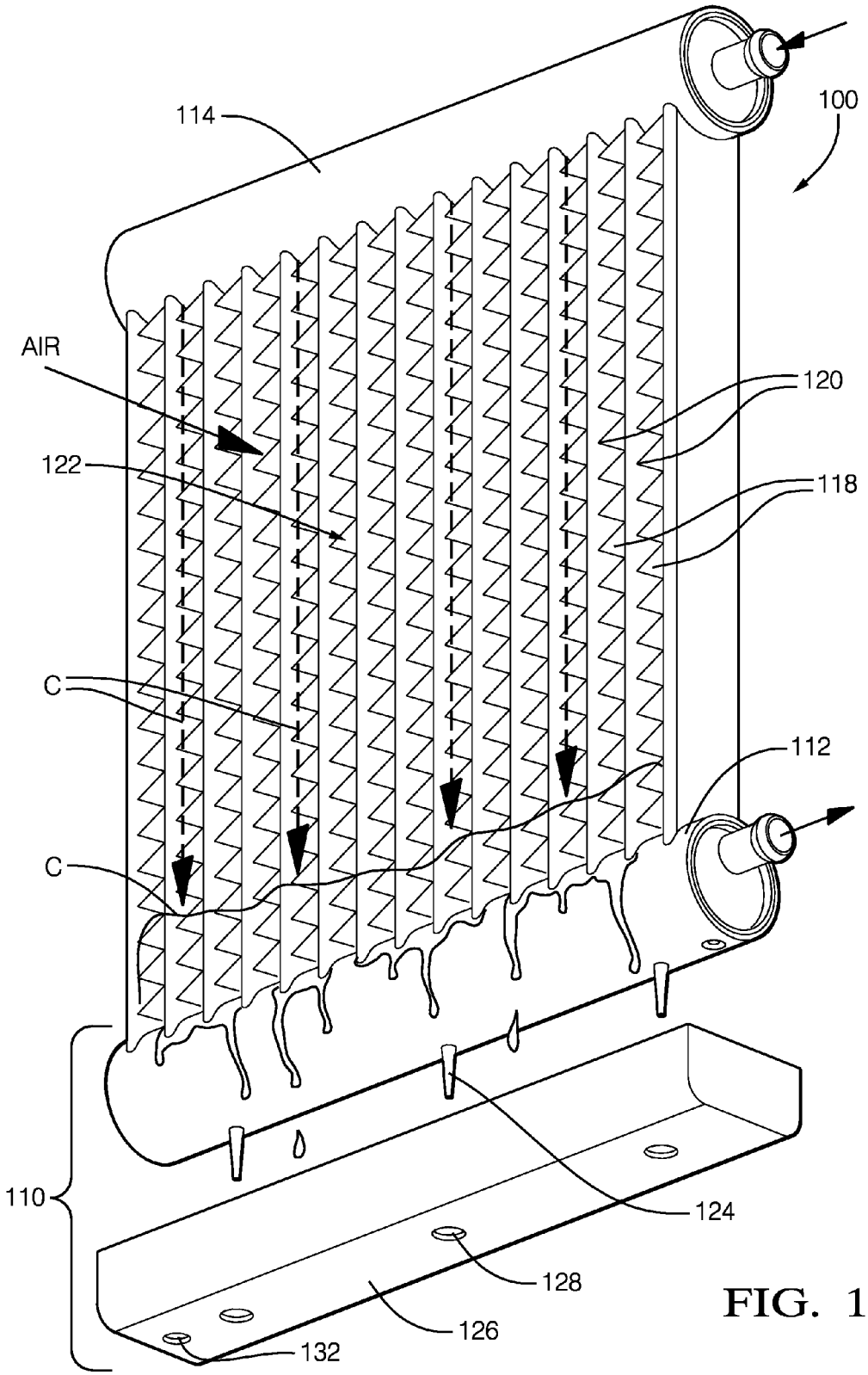
FIG. 1 shows a perspective view of a heat exchanger assembly including a lower manifold having a plurality of pins and a condensate drainage tray spaced from the lower manifold.
Figure 2:
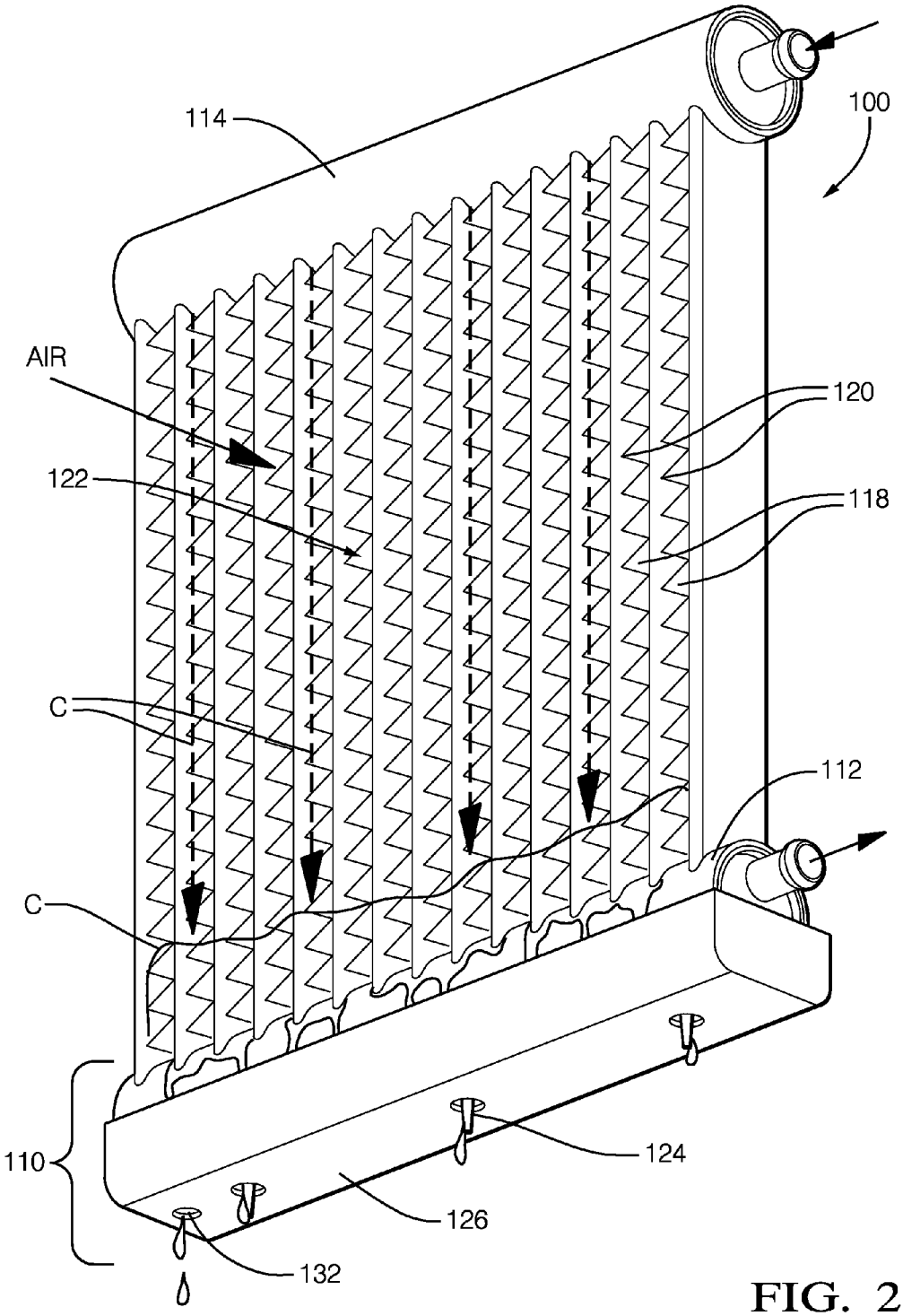
FIG. 2 shows a perspective view of a heat exchanger assembly of FIG. 1 having the plurality of pins extending through corresponding drainage holes in the adjacent condensate drainage tray.
Figure 3:
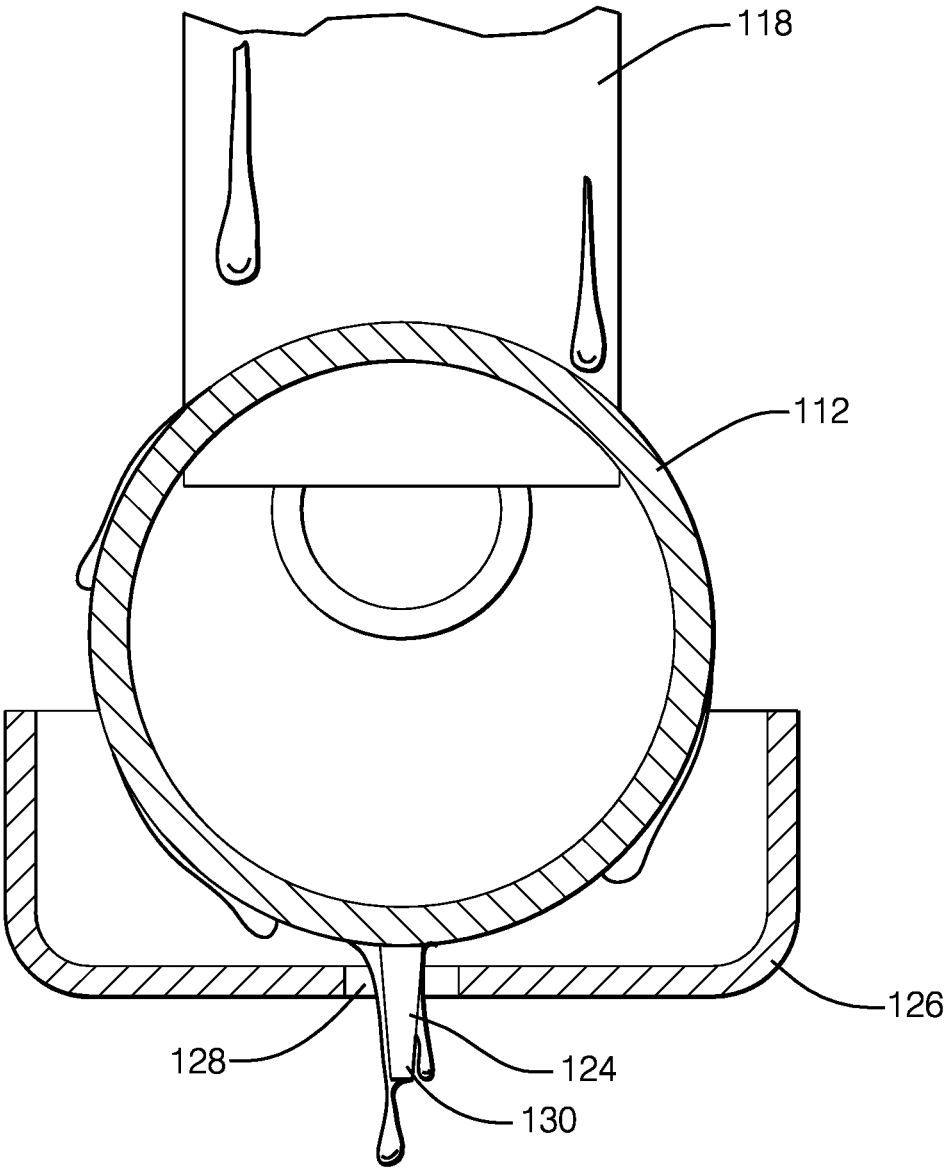
FIG. 3 shows is a cross section of line 3-3 of FIG. 2 showing a tapered pin extending through a drainage hole in the condensate drainage tray.

Referring to FIGS. 1-3 is a heat exchanger assembly 100 having an improved heated condensate drainage system 110 for a heat pump system. The heat exchanger assembly 100 includes a first manifold 112 and a second manifold 114 extending in a spaced and substantially parallel relationship with the first manifold 112. A plurality of substantially parallel refrigerant tubes 118 is provided for hydraulic communication between the first and second manifolds 112, 114. A plurality of corrugated fins 120 is inserted between adjacent refrigerant tubes 118 for increased heat transfer efficiency. The refrigerant tubes 118 and corrugated fins 120 define the heat exchanger core 122. The exterior surfaces of the refrigerant tubes 118 cooperate with the exterior surfaces of the corrugated fins 120 to define a plurality of airflow channels for airflow through the core 122.

For residential application of the heat exchanger assembly 100 in a heat pump system, the first and second manifolds 112, 114 are typically oriented perpendicular to the direction of gravity, while the refrigerant tubes 118 are oriented substantially in or tilted toward the direction of gravity. Operating in evaporative mode, a partially expanded two-phase refrigerant enters the lower portions of the refrigerant tubes 118 from the first manifold 112. As the two phase refrigerant flows upward through the refrigerant tubes 118, the refrigerant expands into a vapor phase by absorbing heat energy from a stream of ambient air flow that passes through the core 122 of the heat exchanger assembly 100 through the airflow channels.

As heat energy is transferred from the outside ambient airflow to the refrigerant, the airflow may be cooled below its dew point. Any moisture in the airflow may condense and accumulate onto the exterior surfaces of the refrigerant tubes 118 and exterior surfaces of the fins 120. As the condensation migrates through the fins 120 toward the lower portion of the heat exchanger assembly 100, the accumulation of condensate between adjacent refrigerant tubes 118 may form a column of condensate (C) between the refrigerant tubes 118. If the ambient air temperature is below the freezing temperature of water, the column of condensate may freeze and expand, thereby damaging the refrigerant tubes 118 and fins 120 of the lower portion of the heat exchanger. Moisture in the ambient air may also condense onto the frozen column of condensate and accumulate into a blanket of ice covering the entire core 122 of the heat exchanger assembly 100.

To prevent accumulation of frozen condensate, the refrigerant loop may be reversed for a short period of time where the outdoor heat exchanger assembly 100 functions as a condenser, such that a hot refrigerant flows through the outdoor heat exchanger assembly 100 to melt, or defrost, the frozen condensate. As the frozen condensate melts, the liquid condensate flows under the force of gravity to the lower manifold 112. A heated condensate drainage system 110 is provided to convey the melted condensate away from the heat exchanger assembly 100 during the defrost cycle to prevent the liquid condensate from accumulating on the lower manifold 112 and refreezing once the defrost cycle ends.

The heated condensate system includes a drainage tray 126 placed immediately below the lower manifold 112, such that any condensate flowing onto the lower manifold 112 from the core 122 drips into the condensate tray 126. The condensate drainage tray 126 may define drainage holes 128 periodically along the length of the tray 126. The drainage tray 126 may be sloped such that the condensate drains toward an end drainage hole 132 located at an end of the drainage tray 126. A plurality of corresponding elongated members 124, such as pins 124, is provided in the lower manifold 112. The pins 124 extend from the lower manifold 112 and through the corresponding drainage holes 128 as shown in FIG. 3. The cross sectional area of the pins 124 are smaller than the cross sectional area of the corresponding drainage holes 128 such that the pins 124 allow for space for the condensate to flow through the drainage holes 128. At least one pin 124 may include a distal end 130 spaced from the manifold 112 and the pin may be tapered toward the distal end 130.

As the melted liquid condensate flows down the exterior of the refrigerant tubes 118 and exterior surface of the lower manifold 112, the individual condensate droplets combine with other condensate droplets until the larger droplets either drip off the manifold 112 onto the drainage tray 126, or due to capillary action, drawn to the pins 124 extending from the manifolds 112. As the pins 124 extends through the drainage hole 128 of the condensate tray 126, the pins 124 guides the melted condensate through the drainage holes 128, thereby conveying condensate away from the heat exchanger assembly 100 and avoiding buildup of condensate. In other words, the pins 124 function as, in essence, down sprouts for the water to drain through the drainage holes 128.

During the defrost cycle, the temperature of the lower manifold 112 may rise to a range of 120 to 140° F. It is preferable that the pins 124 are manufactured form a heat conductive material to conduct heat energy from the lower manifold 112, while the refrigerant loop is reversed to provide hot refrigerant to the heat exchanger assembly 100, to prevent liquid condensate from freezing onto the pins 124 and to melt any ice obstructing the drainage holes 128. It is preferable for the lower manifold 112 and extending pins 124 to be manufactured from a heat conductive material and amendable to brazing to the manifold 112, such as aluminum. The manifolds 112, 114, refrigerant tubes 118, fins 120, and pins 124 may be assembled into the heat exchanger assembly 100 and brazed by any known methods in the art to provide a solid liquid tight heat exchanger assembly 100.

The heat exchanger assembly 100 having a heated condensate drainage system 110 disclosed herein provides a simple and elegant solution to extract and convey frozen condensate away from the core 122 if the heat exchanger assembly 100. The conveyance of condensate away from the core 122 minimalizes the obstruction of airflow through the core 122, thereby improving heat transfer efficiency and eliminates condensate launching from the core 122 into the plenum downstream. The pins 124 conduct heat energy from the manifold 112 to melt any ice that may have built up during the evaporator mode to clear a path for condensate to drain from the drainage tray 126.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description.

Having described the invention, it is claimed:

1. A heat exchanger assembly for a heat pump system, comprising:

a manifold defining a manifold axis; and at least two elongated members spaced apart along the manifold axis and extending downward from a bottom outer surface of the manifold.

2. The heat exchanger assembly of claim 1, further comprising a condensate drainage tray positioned adjacent the manifold;

wherein the drainage tray includes at least two drainage holes forming perforations through the drainage tray, and wherein each of the at least two elongated members extends from the manifold in a direction toward one of the at least two drainage holes.

3. The heat exchanger assembly of claim 2, wherein each of the at least two elongated members extends downward through one of the at least two drainage holes.

4. The heat exchanger assembly of claim 3, wherein inside the drainage holes, each of the at least two elongated members has a cross sectional shape having an area sufficiently less than the area of the drainage hole such that condensate is capable of flowing through an annular pap between the elongated member and an edge of the drainage hole, through which the elongated member extends.

5. The heat exchanger assembly of claim 4, wherein the condensate drainage tray is positioned beneath the manifold such that a portion of condensation liquid forming on the manifold drips into the drainage tray.

6. The heat exchanger assembly of claim 5, wherein each of the at least two elongated members is formed of a heat conductive material amendable to brazing.

7. The heat exchanger assembly of claim 6, wherein each of the at least two elongated members comprises aluminum.

8. The heat exchanger assembly of claim 5, wherein the drainage tray is tilted at an angle with respect to the manifold.

9. The heat exchanger assembly of claim 6, wherein at least one of the at least two elongated members is a pin.

10. The heat exchanger assembly of claim 9, wherein the pin includes a distal end remote from the manifold, and wherein the pin is tapered toward the distal end.

11. A heat exchanger assembly comprising:

a manifold defining a horizontal manifold axis and having a plurality of pins extending substantially in the direction of gravity away from a bottom surface of the manifold;

a condensate drainage tray positioned beneath the manifold, wherein the drainage tray includes a bottom and a plurality of drainage holes through the bottom; and each of the pins extends through a corresponding one of the drainage holes.

12. The heat exchanger assembly of claim 11 wherein each of the plurality of pins includes a diameter smaller than the diameter of the drainage hole to allow for condensate to flow through an annular gap between the pin and an edge of the drainage hole.

13. The heat exchanger assembly of claim 12, wherein at least one of the pins includes a distal end, and wherein the pin is tapered toward the distal end.

14. The heat exchanger assembly of claim 13, wherein the drainage tray is tilted with respect to the manifold.

15. The heat exchanger assembly of claim 13, wherein the at least one of the pins is formed of a heat conductive material.

* * * * *